United States Patent [19]

Kamezaki

[11] Patent Number: 4,577,587

[45] Date of Patent: Mar. 25, 1986

[54] DEVELOPING APPARATUS

[75] Inventor: Yasushi Kamezaki, Sakai, Japan

[73] Assignee: Mita Industrial Co., Ltd., Osaka, Japan

[21] Appl. No.: 717,012

[22] Filed: Mar. 28, 1985

[30] Foreign Application Priority Data

| | | | |
|---|---|---|---|
| Mar. 30, 1984 | [JP] | Japan | 59-47155 |
| May 16, 1984 | [JP] | Japan | 59-47528 |
| May 16, 1984 | [JP] | Japan | 59-72527 |
| May 16, 1984 | [JP] | Japan | 59-72529 |

[51] Int. Cl.[4] ..... G03G 15/09

[52] U.S. Cl. ..... 118/658; 355/3 DD

[58] Field of Search ..... 118/658; 355/3 DD

*Primary Examiner*—Bernard D. Pianalto

*Attorney, Agent, or Firm*—Sherman and Shalloway

[57] ABSTRACT

Disclosed is a developing apparatus using a two-component type developer, which comprises a hopper provided with a toner feed roller, a developer delivery sleeve rotating in a direction reverse to the rotation direction of a photosensitive drum and having a magnet arranged in the interior thereof, a stirring roller for effecting frictional charging of toner particles and uniform mixing of a toner and a carrier, said stirring roller rotating in the same direction as the rotation direction of the developer delivery sleeve and being provided with a plurality of stirring vanes, an earing plate for controlling the earing length of a magnetic brush formed on the developer delivery sleeve, and a developer flow guiding mechanism arranged above the stirring roller, wherein the top end of each stirring vane is bent in the rotation direction of the stirring roller and a notch is formed on each stirring vane, a spiral passage is formed on the stirring roller by the notches of the stirring vanes, and the developer flow guiding mechanism comprises a partition plate and a plurality of guide plates arranged at predetermined intervals at least on the upper face of the partition plate.

8 Claims, 7 Drawing Figures

DEVELOPING APPARATUS

BACKGROUND OF THE INVENTION (1) Field of the Invention

The present invention relates to a developing apparatus using a two-component type developer. More specifically, the present invention relates to a developing apparatus using a two-component type developer, in which stirring mixing of a toner and a carrier is effectively accomplished.

(2) Description of the Prior Art

As the method for developing an electrostatic latent image with a magnetic brush, there are known a developing method using a two-component type developer comprising a magnetic carrier and a toner and a developing method using a one-component type developer comprising toner particles alone. The former method is advantageous in that charges can be given to the toner stably, and the latter method is advantageous in that the troublesome operation of adjusting the toner concentration is not necessary and the property of reproducing a halftone is higher than in the former method.

Recently, it is required that a reproduced image should have a high contrast, that is, a clear shade, and a halftone should be beautifully reproduced. The developing method using a one-component type developer is effective for satisfying these requirements. However, since the upper threshold value of the developing condition is ordinarily determined by the force of magnetically attracting the developer to the developing sleeve and the Coulomb force to the electrostatic latent image and the magnetic material is dispersed in the binder resin in the one-component type developer, the magnetic attractive force of the one-component type developer to the sleeve is weaker than that of the magnetic carrier and hence, fogging is readily caused in the developing method using a one-component tyep developer. In order to solve this problem, in an ordinary developing method using a one-component type developer, the earing length of the magnetic brush is shortened so as to prevent occurrence of fogging. However, in this case, such troubles as insufficient earing and reduction of the flowability of the developer are caused and when the copying machine is continuously used, if a foreign substance such as paper dust is incorporated into the magnetic brush, stable earing becomes difficult.

Accordingly, research is continued with a view to improving the halftone-reproducing property by using a developing method using a two-component type developer where a stable magnetic brush can be formed and sufficient charges can be given to the toner. For example, there is known a method in which in the developing zone the moving direction of a photosensitive drum having an electrostatic latent image is made in agreement with the moving direction of the magnetic brush (hereinafter referred to as "the same direction development"). In this method, the development time can be prolonged and the sliding frictional force can be reduced, and therefore, this method is advantageous in the reproduction of a halftone over a method in which the moving direction of the photosensitive drum is reverse to the moving direction of the magnetic brush (hereinafter referred to as "the reverse direction development"). Moreover, the same direction development is advantageous in that leakage of the charge of the electrostatic latent image by the carrier can be prevented.

However, if this same direction development method is adopted, the size of the developing apparatus becomes larger than the size of the developing apparatus used for the reverse direction development method. The reason is as follows.

In case of the reverse direction development, in mixing and stirring a toner and a magnetic carrier (often referred to as "carrier" hereinafter), the developer in which the toner has been consumed in the developing zone is once scraped down from the surface of the developing sleeve by a scraper and the developer thus scraped down is sufficiently mixed and stirred with the newly supplied toner and the developer left in the developing apparatus. Then, the mixed and stirred developer is retained on the sleeve at a developer pumpup position located in the lower portion of the sleeve and is fed to the developing zone again after attainement of a certain earing length by an earing member. Namely, in the reverse direction development, by forming one loop of the above operations, mixing and stirring of the developer can be performed at a high efficiency. In contrast, in the same direction development, formation of an operation loop as mentioned above is difficult. Namely, in the case where a scraper is arranged in the lower portion of the sleeve to scrape down the used developer, it becomes necessary to form a reservoir zone below the position of the scraper so as to store the developer scraped down and a mechanism for pumping up the developer to the upper portion of the sleeve. If such a mechanism is not arranged and the scraper is stationarily arranged in the state buried in the developer, circulation of the developer in the developing apparatus is hindered and the significance of provision of the scraper is arranged in the upper portion of the sleeve as in case of the reverse direction development, because of the relation of the position of the scraper to the developer pump-up position, the loop becomes inevitably complicated. Accordingly, in each case the size of the developing apparatus is increased.

SUMMARY OF THE INVENTION

It is a primary object of the present invention to provide a development apparatus using a two-component type developer, in which when the same direction development is carried out, mixing and stirring of a toner and a carrier can be performed at a high efficiency by a compact structure.

More specifically, in accordance with the present invention, there is provided a developing apparatus using a two-component type developer, which comprises a hopper provided with a toner feed roller, a developer delivery sleeve rotating in a direction reverse to the rotation direction of a photosensitive drum and having a magnet arranged in the interior thereof, a stirring roller for effecting frictional charging of toner particles and uniform mixing of a toner and a carrier, said stirring roller rotating in the same direction as the rotation direction of the developer delivery sleeve and being provided with a plurality of stirring vanes, an earing plate for controlling the earing length of a magnetic brush formed on the developer flow guiding mechanism arranged above the stirring roller, wherein the top end of each stirring vane is bent in the rotation direction of the stirring roller and a notch is formed on each stirring vane, a spiral passage is formed on the stirring roller by the notches of the stirring vanes, and the developer flow guiding mechanism comprises a partition plate and a plurality of guide plates arranged at predetermined intervals at least on the upper face of the partition plate.

DETAILED DESCRIPTION OF THE INVENTION

Figure 1:
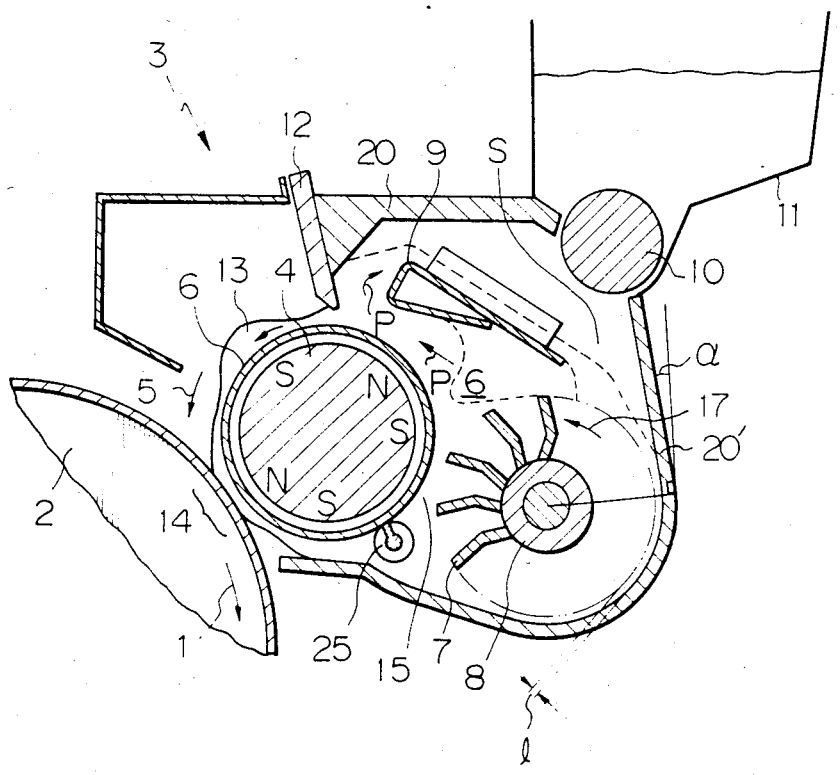
FIG. 1 is a sectional view illustrating the developing apparatus according to the present invention.

Referring to FIG. 1 which is a sectional view diagrammatically illustrating the developing apparatus according to the present invention, this developing apparatus entirely represented by reference numeral 3 is arranged to consturct a copying machine together with a photosensitive drum 2 rotating in a direction of arrow 1. The developing apparatus 3 comprises a nonmagnetic cylindrical sleeve 56 rotating in a direction of arrow 5 and having, arranged in the interior thereof on the side of the photosensitive drum 3, a magnet 4 having a plurality of magnetic poles on the surface, a developer stirring roller 8 provided with a plurality of stirring vanes 7, a developer flow guiding mechanism 9 located above the stirring roller 8, a toner hopper 11 arranged above the falling position of the developer falling from the developer flow guiding mechanism 9 onto the stirring roller 8 and provided with a toner feed roller 10, and an earing blade 12 for controlling the earing length of a magnetic brush formed on the sleeve 6 to a predetermined constant length.

As shown in FIG. 1, these members are contained in a housing 20.

In the developing apparatus having the abovementioned structure, the developer travels along a course described below. Namely, the developer comprising a toner and a carrier forms a magnetic brush 13 on the sleeve 6 by the action of the magnet 4 arranged in the interior of the sleeve 6, and this magnetic brush 13 is delivered to a developing zone 14 with rotation of the sleeve 6. In the developing zone 14, a toner image corresponding to an electrostatic latent image on the surface of the photosensitive drum is formed and development is effected. After the development, the magnetic brush 13 in which the toner has been consumed is moved to a developer scraping zone 15 with rotation of the sleeve 6. Since the scraper zone 15 is adjacent to poles of the same polarity of the magnet, the developer receives a repulsive magnetic field and is separated from the sleeve.

The scraped developer is mixed and stirred with the toner appropriately supplied from the hopper 11 located above and the developer falling from the guiding mechanism 9 with rotation of the stirring vanes 7 in a direction of arrow 17, and the developer is delivered to a developer pump-up position 16. At this pump-up position 16, the developer is magnetically attracted onto the sleeve 6 again and is delivered along the lower face of the guiding mechanism 9 with rotation of the sleeve 6. Then, the amount of the developer is controlled to a predetermined constant amount by the earing blade 12, and a part of the developer is delivered as the magnetic brush 13 to the developing zone 14 while the remaining portion of the developer is moved along the upper face of the guiding mechanism 9 and is fed to the stirring roller 8 again. Thus, a regular flow of the developer is formed in the developing apparatus of the present invention.

According to the present invention, movement of the flow of the developer is smoothly performed and mixing and stirring can be accomplished at a high efficiency by this movement. Furthermore, sufficient charges can be given even to the newly supplied toner and uniform mixing can be attained. The present invention has various structural features for attaining these effects.

In the first place, the developing apparatus of the present invention is characterized in that scraping of the developer present on the sleeve 6 and stirring of the developer are performed by using the stirring roller 8.

The stirring vanes 7 are formed on the stirring roller 8 so that a certain space is formed between the top ends of the stirring vanes 7 and the sleeve 6, and because of the presence of this space, the developer on the sleeve 6 is not completely scraped. Since only the toner present in the surface portion of the mangetic brush is consumed for the development, it is sufficient if scraping is performed so that this surface portion is scraped. For this reason, the above-mentioned space is formed between the top ends of the stirring vanes 7 and the sleeve 6. Furthermore, if this structure is adopted, the rotation torque of the stirring roller 8 is reduced and the rotation can be performed smoothly.

Figure 2:
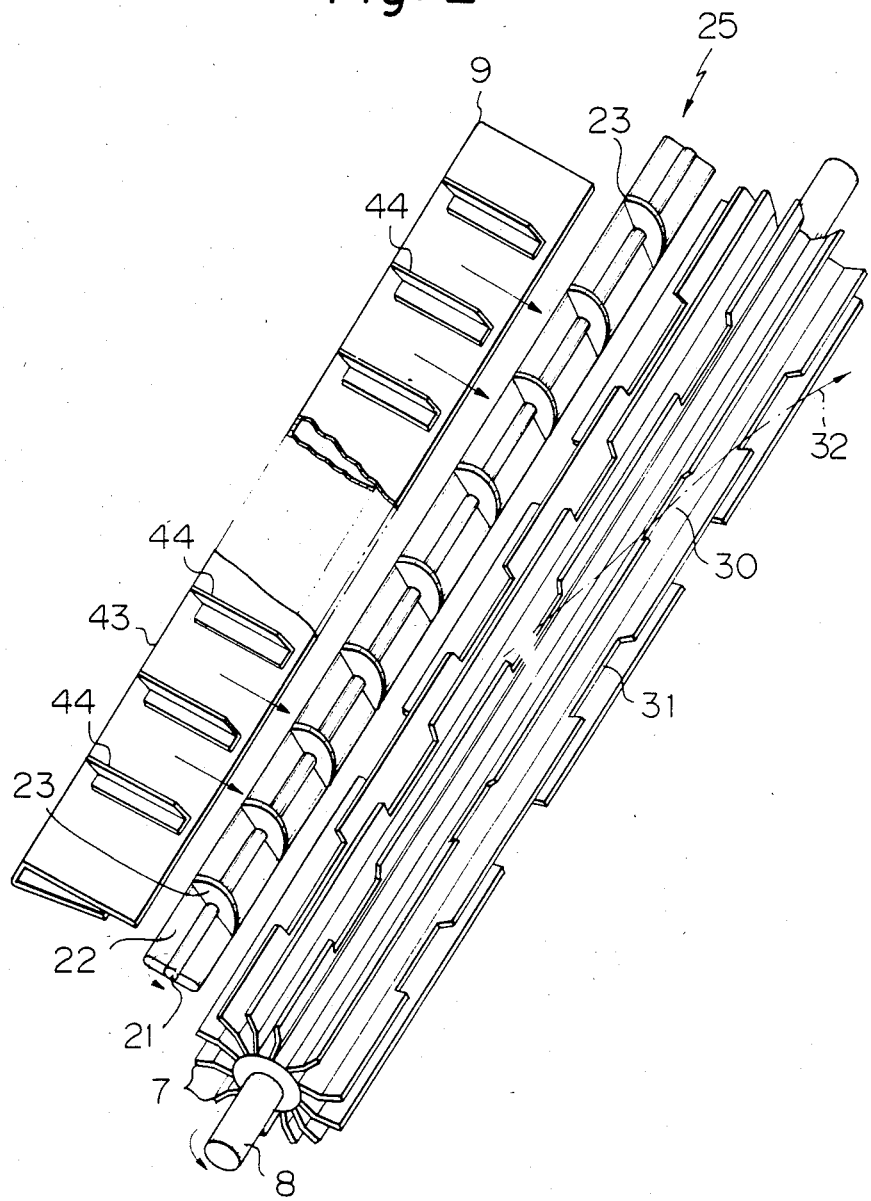
FIG. 2 is a partial perspective view showing the developing apparatus according to the present invention.

In the case where it is necessary to scrape all of the developer present on the sleeve 6, a scraping roller 25 is arranged in the lower portion of the space between the sleeve 6 and stirring vanes 7 adjacently to the sleeve 6. For example, as shown in FIG. 2, the scraping roller 25 preferably comrpises a linear plate vane 22 having a central axis 21 and a plurality of oval vanes 23 arranged at predetermined intervals on both the sides of the plate vane 22 in the state oriented in a certain direction. In this embodiment, there can be attained not only an effect of scarping the developer but also an effect of mixing and stirring the developer. Namely, with rotation of the scraping roller 25, the developer is scraped from the surface of the sleeve 6 by the plate vane 22 or oval vanes 23, and simultaneously, the developer is forcibly discharged in the orienting direction of the oval vanes 23 toward the stirring roller 8. Accordingly, as compared with the case where a plate-like scraper is formed to about against the surface of the sleeve, in this case the developer can be scraped, mixed and stirred more smoothly and effectively in the state where the scraper is buried in the developer.

Figure 3:
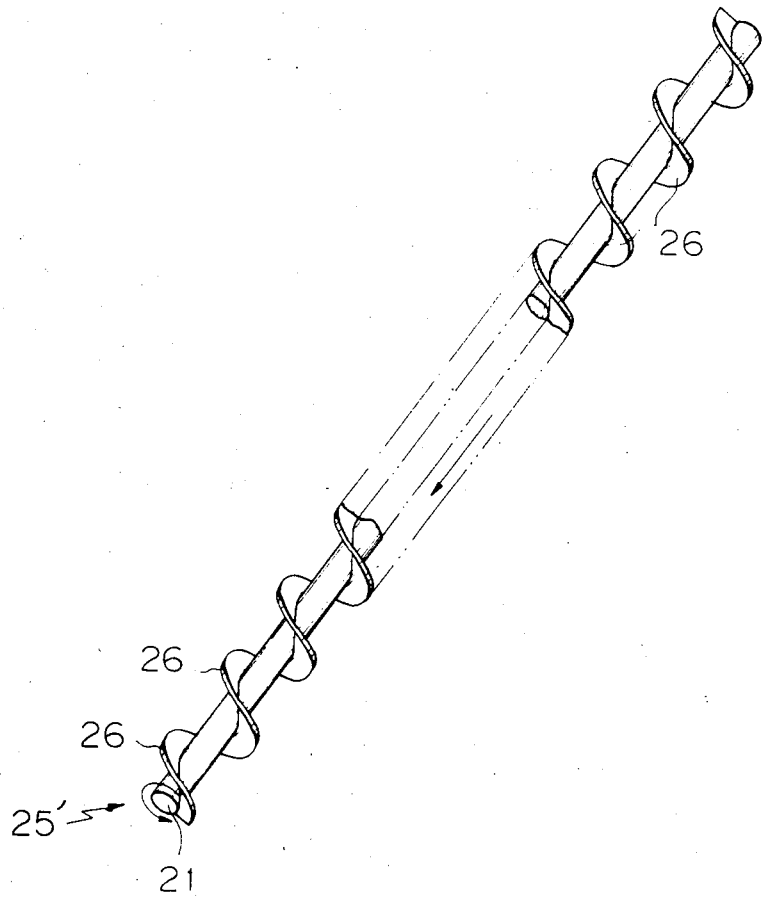
FIG. 3 is a perspective view showing a scraping roller preferably used in the present invention.

Furthermore, as shown in FIG. 3, a spiral roller 25' having a spiral vane 26 is disposed instead of the scraper roller 25. Also in this case, the scraping effect and the mixing and stirring effect can be similarly attained.

In the present invention, the top end portions of the stirring vanes 7 arranged on the stirring roller 8 are bent in the rotation direction to enhance the effect of scraping the developer on the sleeve 6.

Referring to FIGS. 1 and 2, in order for the stirring roller 8 used in the present invention to exert a function of delivering the developer present on the sleeve 6 to the pump-up position 16 in addition to the mixing and stirring action, a developer delivery space 30 is formed between every two adjacent stirring vanes 7, and notches 31 are formed on the respective stirring vanes 7 so that the notches 31 are gradually deviated in the lateral direction in the respective stirring vanes 7, whereby a spiral passage 32 extending along the deviation direction is formed on the peripheral face of the stirring roller 8.

Accordingly, the developer is moved in the above-mentioned developer delivery spaces with rotation of the stirring vanes 7 and the developer is delivered in the direction of arrow 32 with rotation of the stirring roller 8 in the direction of arrow 17. Therefore, by using the stirring roller 8 having the above-mentioned structure, not only scraping of the developer from the sleeve 6 but also mixing of the developer can be performed effectively.

Figure 4:
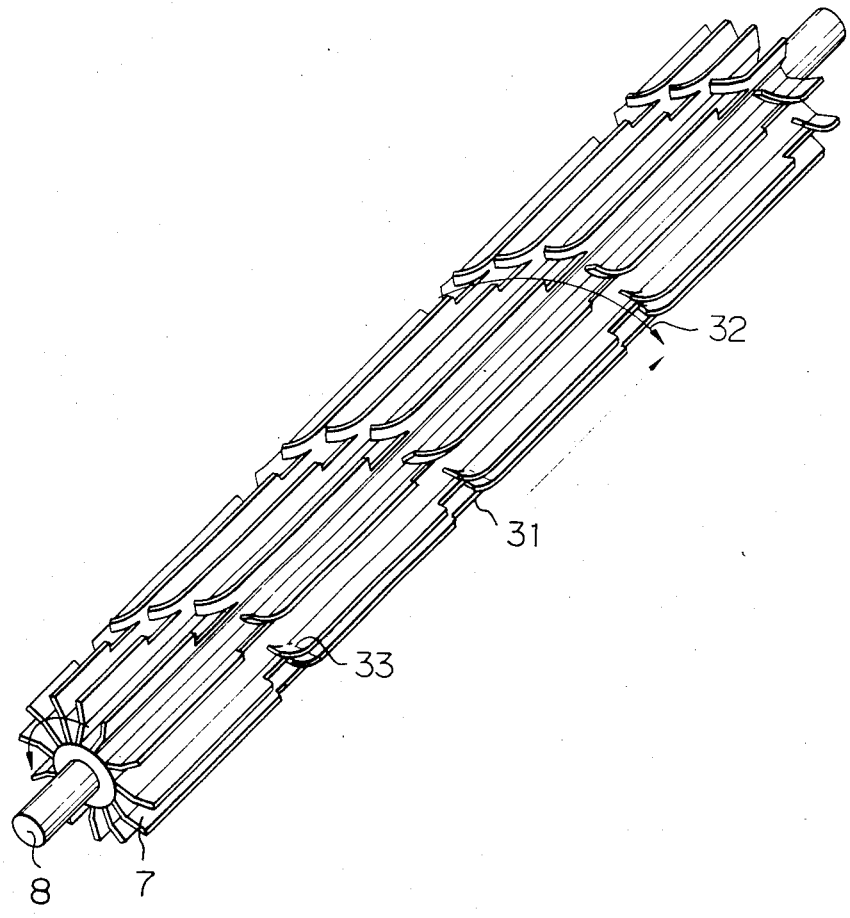
FIG. 4 is a perspective view showing a stirring roller preferably used in the present invention.

In the present invention, by forming a guide 33 by bending a part of the stirring vane 7 toward one side end of the notch 31 as shown in FIG. 4, the abovementioned mentioned delivery and movement of the developer can be performed more promptly.

The second characteristic feature of the present invention is that the developer flow guiding mechanism 9 is arranged above the stirring roller 8 and the developer removed from the sleeve 6 by the earing blade 12 is smoothly supplied onto the stirring roller 8 again. By dint of this feature, a definite flow of the developer is established as indicated by arrow P in FIG. 1, and scraping of the developer and mixing and stirring of the developer can be performed smoothly and effectively.

As shown in FIG. 2, this developer flow guiding mechanism 9 comprises a partition plate 43 arranged on the upper side of the stirring roller 8 and guide plates 44 arranged on the top face of the partition plate 43 at predetermined intervals (for example, about 20 mm). Namely, the developer removed from the sleeve 6 by the earing blade 12 is passed through the top face of the partition plate 43 and directed onto the stirring roller 8 by the guide plates 44.

Figure 5:
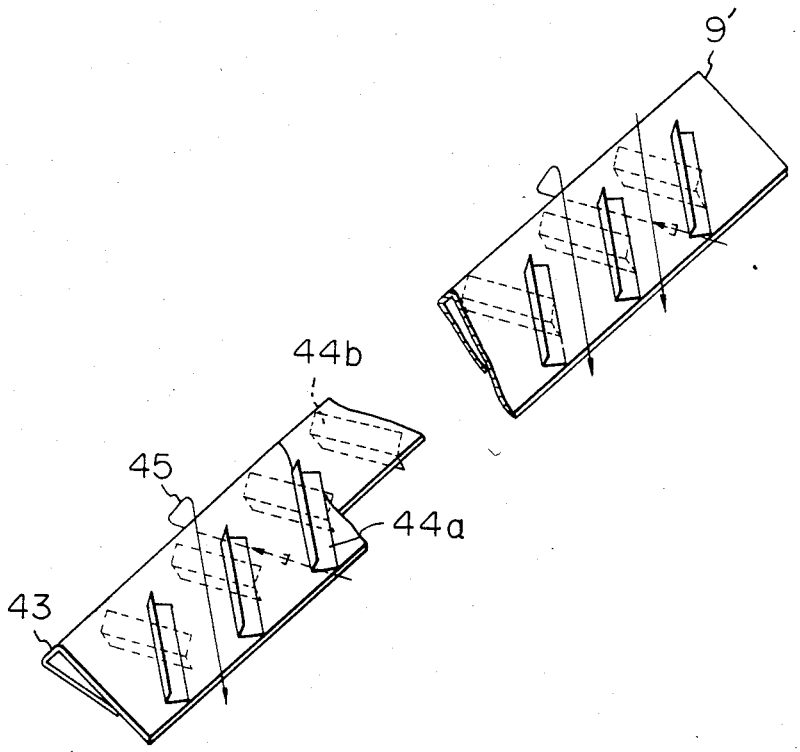
FIG. 5 is a perspective view showing a developer flow guiding mechanism preferably used in the present invention.

One modification 9' of this developer flow guiding mechanism 9 is shown in FIG. 5, and by using this guiding mechanism 9', the effect of mixing and stirring the developer is further enhanced. In this modification, guide plates **44*a* and 44*b* are arranged on the upper and lower faces of the partition plate 43, respectively. The guide plates 44*a* formed on the paper face are arranged in parallel to each other and have an acute angle to the axis of the stirring roller 8, and the guide plates 44*b* formed on the lower face are arranged in parallel to each other and have an obtuse angle to the axis of the stirring roller 8**.

The developer delivered by the stirring roller 8 and pumped up onto the sleeve 6 is moved as indicated by arrow 45 form the lower face of the partition plate 43 to the upper face of the partition plate 43. Accordingly, the direction of the movement of the developer on the partition plate 43 is, as a whole, reverse to the direction of the movement of the developer in the developer delivery space 20 in the stirring roller 8. Therefore, by combining this developer flow guiding mechanism 9' with the stirring roller 8, the effect of mixing and stirring the developer can be further increased.

Figure 6:
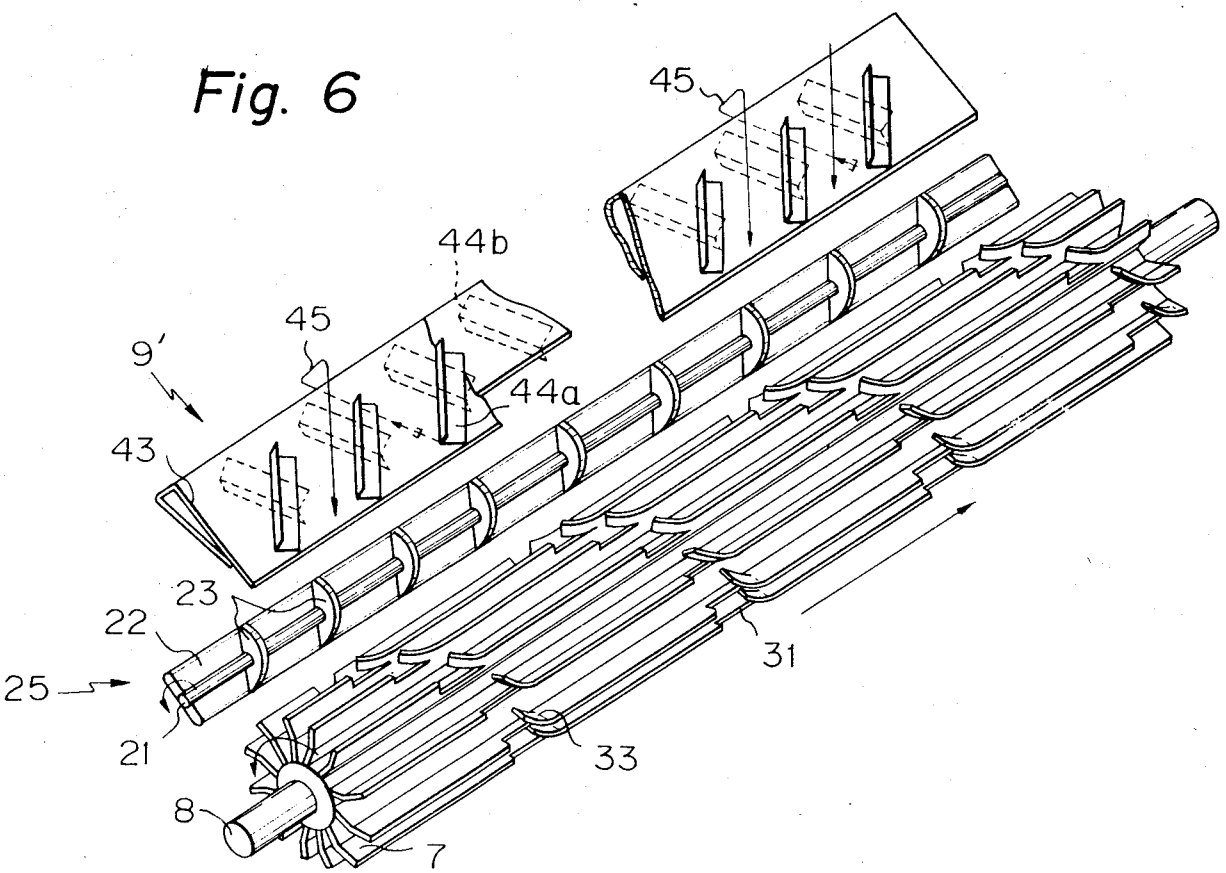
FIGS. 6 and 7 are partial perspective views showing preferred embodiments of the developing apparatus according to the present invention.
Figure 7:
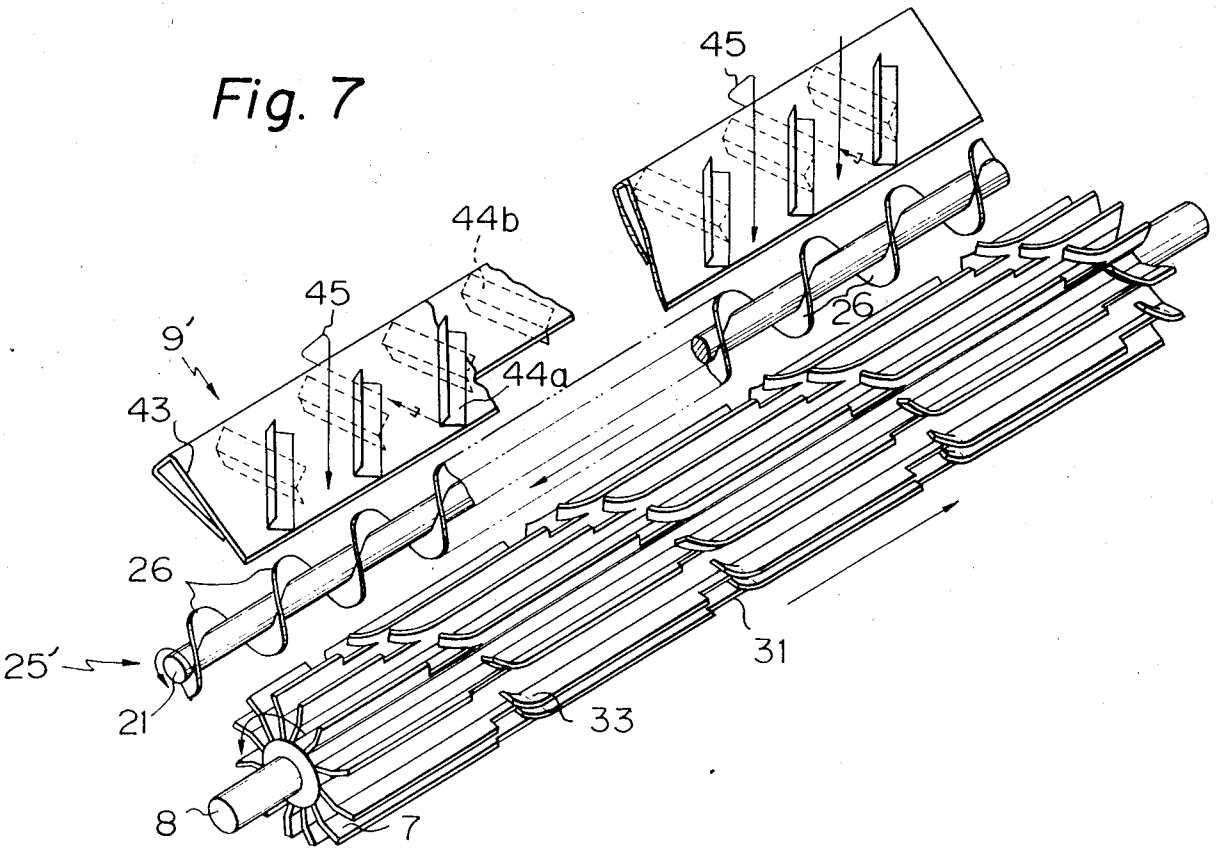

Most preferred embodiments of the developing apparatus of the present invention are illustrated in FIGS. 6 and 7. These two embodiments are different from each other only in the shape of the scraping roller 25. Namely, a plate-like scraping roller 25 (see FIG. 6) or a spiral scraping roller 25' (see FIG. 7) is arranged as the scraping roller 25, and the scraping roller 25 or 25' is combined with the developer flow guiding mechanism 9' shown in FIG. 5. In these embodiments, it is important that the extending direction of vanes of the scraping roller 25 or 25' or the rotation direction thereof should be determined so that the direction of the movement of the developer by the scraping roller 25 or 25' is reverse to the direction of the movement of the developer by the stirring roller 8. Namely, if the above-mentioned extending direction or rotation direction is the same as the moving direction of the developer, the effect of mixing and stirring the developer is reduced.

In the present invention, in order to perform the delivery and circulation of the developer at a high efficiency, it is preferred that, referring to FIG. 1, the wall surface 20' of the housing 20 on the side opposite to the side where the sleeve 6 is located be inclined toward the stirring roller 8. If this arrangement is adopted, the delivery and circulation of the developer can be performed at a high efficiency. It is preferred that this wall surface 20' be curved along the loci of the top ends of the stirring vanes 7, and be inclined at a certain angle $\alpha$, for example, 3° to 40°, especially 5° to 20°, from the horizontal plane including the axis of the stirring roller 8. It also is preferred that the distance l between the curved portion of the wall surface 20' and the top end of the stirring vane 7 be within 5 mm. According to this preferred embodiment, the delivery, mixing and stirring of the developer can be performed smoothly and effectively without unreasonable residence of the developer in the developing apparatus.

I claim:

1. A developing apparatus using a two-component type developer, which comprises a hopper provided with a toner feed roller, a developer delivery sleeve rotating in a direction reverse to the rotation direction of a photosensitive drum and having a magnet arranged in the interior thereof, a stirring roller for effecting frictional charging of toner particles and uniform mixing of a toner and a carrier, said stirring roller rotating in the same direction as the rotation direction of the developer delivery sleeve and being provided with a plurality of stirring vanes, an earing plate for controlling the earing length of a magnetic brush formed on the developer delivery sleeve, and a developer flow guiding mechanism arranged above the stirring roller, wherein the top end of each stirring vane is bent in the rotation direction of the stirring roller and a notch is formed on each stirring vane, a spiral passage is formed on the stirring roller by the notches of the stirring vanes, and the developer flow guiding mechanism comprises a partition plate and a plurality of guide plates arranged at predetermined intervals at least on the upper face of the partition plate.

2. A developing apparatus as set forth in claim 1, wherein a guide is formed on one side end of said notch in each stirring vane by bending the stirring vane, and a spiral passage is formed on the stirring roller by the notches and guides of the respective stirring vanes.

3. A developing apparatus as set forth in claim 1 or 2, wherein the guide plates of the developer flow guiding mechanism are arranged on the upper and lower faces of the partition plate at predetermined intervals, the guide plates are oriented in a direction forming an acute or obtuse angle to the axial direction of the stirring roller, the guide plates formed on the upper face of the partition plate (first guide plates) are arranged substantially in parallel to each other and the guide plates formed on the lower face of the partition plate (second guide plate) are arranged substantially in parallel to each other, and the orienting directions of the first guide plates and the second guide plates intersect each other.

4. A developing apparatus as set forth in claim 2 or 3, wherein a roller for scraping the developer present on the surface of the developing delivery sleeve is disposed at a position close to the surface of the sleeve upstream, relative to the rotation direction of the sleeve, of the position where the developer delivery sleeve becomes closest to the stirring roller.

5. A developing apparatus as set forth in claim 4, wherein the roller for scraping the developer present on the surface of the developer delivery sleeve is a spiral roller and the direction of a spiral passage formed on said spiral roller is reverse to the direction of the spiral passage formed on the stirring roller.

6. A developing apparatus as set forth in any of claims 1 through 5, wherein the housing is disposed below the hopper to contain therein the developer delivery sleeve, the stirring roller, the earing plate and the developer flow guiding mechanism, and the wall surface of the hopper on the side opposite to the side where the developer delivery sleeve is located is inclined toward the stirring roller.

7. A developing apparatus as set forth in claim 3, wherein a roller for scraping the developer present on the surface of the developing delivery sleeve is disposed at a position close to the surface of the sleeve upstream, relative to the rotation direction of the sleeve, of the position where the developer delivery sleeve becomes closest to the stirring roller.

8. A developing apparatus as set forth in claim 7, wherein the roller for scraping the developer present on the surface of the developer delivery sleeve is a spiral roller and the direction of a spiral passage formed on said spiral roller is reverse to the direction of the spiral passage formed on the stirring roller.

* * * * *

UNITED STATES PATENT AND TRADEMARK OFFICE

CERTIFICATE OF CORRECTION

PATENT NO. : 4,577,587

DATED : March 25, 1986

INVENTOR(S) : YASUSHI KAMEZAKI

It is certified that error appears in the above-identified patent and that said Letters Patent is hereby corrected as shown below:

ON THE TITLE PAGE

[30] Foreign Application Priority Data delete "May 16, 1984 [JP] Japan .....59-47528"
insert --May 16, 1984 [JP] Japan .....59-72528--.

IN THE CLAIMS

Claim 4, line 1, (column 7, line 9),
delete "or 3".

Claim 6, line 2, (column 8, line 2),
delete "through", insert --, 2, 4 or--.

Signed and Sealed this

*Third* Day of *June 1986*

[SEAL]

*Attest:*

DONALD J. QUIGG

*Attesting Officer*

*Commissioner of Patents and Trademarks*